US010527366B2

(12) United States Patent
Kim et al.

(10) Patent No.: US 10,527,366 B2
(45) Date of Patent: Jan. 7, 2020

(54) HEAT EXCHANGER, HEADER FOR THE SAME AND MANUFACTURING METHOD THEREOF

(71) Applicant: SAMSUNG ELECTRONICS CO., LTD., Suwon-si (KR)

(72) Inventors: Dong Hyun Kim, Suwon-si (KR); Jun Kyu Jung, Seoul (KR); Young Min Kim, Suwon-si (KR); Hayase Gaku, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 39 days.

(21) Appl. No.: 15/698,984

(22) Filed: Sep. 8, 2017

(65) Prior Publication Data

US 2018/0073819 A1 Mar. 15, 2018

(30) Foreign Application Priority Data

Sep. 13, 2016 (KR) ..... 10-2016-0118200

(51) Int. Cl.
*F28F 9/02* (2006.01)
*B21D 53/04* (2006.01)
*F28D 1/053* (2006.01)

(52) U.S. Cl.
CPC ..... *F28F 9/028* (2013.01); *B21D 53/04* (2013.01); *F28D 1/05391* (2013.01); (Continued)

(58) Field of Classification Search
CPC ..... F28F 9/0207; F28F 9/028; F28D 1/05341; B21D 53/04
See application file for complete search history.

(56) References Cited

U.S. PATENT DOCUMENTS 2,044,455 A * 6/1936 Witzel ..... F25B 39/02 165/174
2007/0029073 A1 2/2007 Teshima et al.
(Continued)

FOREIGN PATENT DOCUMENTS

CN 103206884 7/2013
CN 103383171 11/2013
(Continued)

OTHER PUBLICATIONS

Extended European Search Report dated Mar. 1, 2018 in European Patent Application No. 17190680.3.
(Continued)

*Primary Examiner* — Paul Alvare
(74) *Attorney, Agent, or Firm* — Staas & Halsey LLP

(57) ABSTRACT

A heat exchanger includes a plurality of tubes having refrigerant flowing therein and arranged to exchange heat with outside air; and a header having a chamber adapted to distribute the refrigerant to the plurality of tubes, wherein the header includes, a base wall having a plurality of tube insertion holes into which the plurality of tubes are inserted, and a partition wall integrally formed with the base wall and configured to divide the chamber into a plurality of sections corresponding to the plurality of tubes. This structure helps reduce the number of parts of the heat exchanger, simplify processing and assembling, and improving the heat transfer performance by improving the distribution of the refrigerant.

15 Claims, 14 Drawing Sheets

(52) U.S. Cl.
CPC ..... *F28F 9/0202* (2013.01); *F28D 1/05341* (2013.01); *F28F 9/0207* (2013.01)

(56) References Cited

U.S. PATENT DOCUMENTS

| | | | | |
|---|---|---|---|---|
| 2007/0144721 | A1* | 6/2007 | Watanabe | F28D 1/05375 165/174 |
| 2007/0204983 | A1* | 9/2007 | Ichiyanagi | F25B 9/008 165/176 |
| 2008/0251245 | A1* | 10/2008 | Gorbounov | F25B 39/028 165/178 |
| 2013/0292104 | A1* | 11/2013 | Park | F28F 9/02 165/173 |
| 2013/0312453 | A1* | 11/2013 | Jeon | F25B 39/028 62/524 |
| 2016/0169596 | A1* | 6/2016 | Jindou | F25B 39/028 62/526 |
| 2017/0219298 | A1* | 8/2017 | Tsutsui | F28F 9/02 |
| 2017/0234587 | A1* | 8/2017 | Jindou | F28F 9/02 62/527 |
| 2017/0292741 | A1* | 10/2017 | Inoue | F25B 39/00 |
| 2017/0299284 | A1* | 10/2017 | Jindou | F25B 13/00 |
| 2017/0314792 | A1* | 11/2017 | Jindou | F25B 39/00 |
| 2017/0343290 | A1* | 11/2017 | Jindou | F25B 39/022 |

FOREIGN PATENT DOCUMENTS

| | | | | |
|---|---|---|---|---|
| CN | 105518392 | | 4/2016 | |
| EP | 2660549 | | 11/2013 | |
| EP | 2860483 | | 4/2015 | |
| EP | 3032182 | | 6/2016 | |
| JP | 2013-130386 | | 7/2013 | |
| JP | WO2013/160952 | | 10/2013 | |
| KR | 10-1462176 | | 11/2014 | |
| WO | WO-2006083451 | A2 * | 8/2006 | F25B 39/028 |
| WO | 2009/048451 | | 4/2009 | |
| WO | 2013/176393 | | 11/2013 | |
| WO | 2016/052304 | | 4/2016 | |
| WO | WO-2016052299 | A1 * | 4/2016 | F25B 39/00 |
| WO | WO-2017029780 | A1 * | 2/2017 | F25B 39/028 |

OTHER PUBLICATIONS

European Communication under Rule 71(3) dated Aug. 8, 2018 in European Patent Application No. 17190680.3.

Chinese Office Action dated Jul. 26, 2019 in Chinese Patent Application No. 201710823087.6.

* cited by examiner

HEAT EXCHANGER, HEADER FOR THE SAME AND MANUFACTURING METHOD THEREOF

CROSS-REFERENCE TO RELATED APPLICATIONS

This application claims the benefit of Korean Patent Application No. 10-2016-0118200, filed on Sep. 13, 2016 in the Korean Intellectual Property Office, the disclosure of which is incorporated herein by reference.

BACKGROUND

1. Field

The present disclosure relates to a header of a heat exchanger for improving refrigerant distribution and a manufacturing method thereof.

2. Description of the Related Art

The heat exchanger includes a plurality of tubes in which the refrigerant flows and exchanges heat with the outside air, a header coupled to the plurality of tubes to exchange refrigerant with the plurality of tubes, and a heat exchange fin to be in contact with the tubes to widen the heat dissipation area, thereby exchanging heat between the refrigerant and the outside air.

Generally, in the process of guiding the refrigerant introduced into the header of the heat exchanger through an inlet pipe to the tube, the refrigerant may not be uniformly distributed to the plurality of tubes due to inclination of the liquid refrigerant by gravity and inertial force. Therefore, a distributor for improving the distribution of the refrigerant is provided inside or outside the header.

Particularly, the structure in which the distributor is embedded in the header has a distributing structure for evenly distributing the refrigerant and a guide structure for guiding the divided refrigerant to the tube, which increases the number of parts constituting the header and the distributor and makes it complicated to manufacture them.

SUMMARY

One aspect of the present disclosure provides a header of a heat exchanger having an improved distribution structure for improving refrigerant distribution, a heat exchanger having the header, and a method of manufacturing the same.

One aspect of the present disclosure provides a header of a heat exchanger that minimizes an increase in the number of components in the process of realizing a distribution structure inside the header and improves processing and assembling convenience, and a heat exchanger having the header and a manufacturing method thereof.

In accordance with one aspect of the present disclosure, a heat exchanger includes a plurality of tubes configured to have a refrigerant flow therein to exchange heat with outside air; and a header having a chamber adapted to distribute the refrigerant to the plurality of tubes, wherein the header comprises, a base wall having a plurality of tube insertion holes, into which the plurality of tubes are inserted, and a partition wall integrally formed with the base wall and configured to divide the chamber into a plurality of sections corresponding to the plurality of tubes.

The header further may comprise a connecting portion to connect the base wall and the partition wall.

The connecting portion may comprise a plurality of bending portions, the connecting portion being bent around the plurality of bending portions.

The plurality of bending portions may comprise a first bending portion bent with respect to a first axis, a second bending portion bent with respect to a second axis, and a third bending portion bent with respect to a third axis.

The first axis, the second axis, and the third axis may be orthogonal to each other.

The partition wall may comprise a plurality of partition walls arranged in the longitudinal direction of the header, and the plurality of partition walls may comprise a first partition wall and a second partition wall adjacent to each other, the first partition wall and the second partition wall being connected to a first connecting portion and a second connecting portion located in opposite directions, respectively.

The base wall may have a partition wall projection insertion hole, and the partition wall has a partition wall projection to be inserted into the partition wall projection insertion hole.

The header comprises a base body including the base wall, the partition wall, and the connecting portion; and a middle body coupled to the base body to form the chamber.

The middle body may comprise a middle sidewall and the middle side wall may be formed with a connecting portion insertion groove into which the connecting portion is inserted.

The middle body may comprise a middle wall, and the middle wall may be provided with a plurality of distribution holes arranged to distribute the refrigerant.

In accordance with one aspect of the present disclosure, a header for heat exchanger comprise a cover body coupled to an inlet pipe arranged to allow a refrigerant to flow therein; a middle body coupled to the cover body to form a distribution chamber for distributing a refrigerant; and a base body coupled to the middle body to form a guide chamber for guiding the refrigerant to a plurality of tubes arranged to exchange heat with the outside air while the refrigerant flows, and the base body includes a base wall with a plurality of tube insertion holes formed therein, into which the plurality of tubes are inserted, and a partition wall formed integrally with the base wall and configured to divide the guide chamber into a plurality of guide sections corresponding to the plurality of tubes.

The base body may further include a connecting portion to connect the base wall and the partition wall.

The connecting portion may comprise a plurality of bending portions, the connecting portion being bent around the plurality of bending portions.

The middle body may have a middle wall with a plurality of distribution holes for distributing the refrigerant of the distribution chamber and a middle sidewall provided on both sides of the middle wall, and the middle sidewall may be formed with a connecting portion insertion groove into which the connecting portion is inserted.

At least a part of the connecting portion may protrude outwards from the middle body.

In accordance with one aspect of the present disclosure, a method of manufacturing a heat exchanger comprises preparing a middle body; preparing a base body including a base wall defining a chamber together with the middle body, a partition wall dividing the chamber into a plurality of sections, and a connecting portion connecting the base wall and the partition wall; and combining the middle body with the base body, and the preparing the base body includes, trimming one plate to form the base wall, the partition wall, and the connecting portion; bending the connecting portion firstly; and bending the connecting part secondarily.

The preparing of the base body may include burring the base wall to form a tube insertion hole, into which the tube is inserted.

The trimming may include forming a partition wall projection, and the preparing of the base body may include piercing the base wall to form a partition wall projection insertion hole provided for the partition wall projection to be inserted to the partition wall projection insertion hole.

The bending of the connecting portion firstly may be performed with respect to the first axis, the bending of the connecting part secondarily may be performed with respect to the second axis, and the first axis and the second axis may be mutually orthogonal.

The preparing of a middle body may include forming a connecting portion insertion groove into which the connecting portion is inserted in the middle body.

BRIEF DESCRIPTION OF THE DRAWINGS

These and/or other aspects of the invention will become apparent and more readily appreciated from the following description of the embodiments, taken in conjunction with the accompanying drawings of which:

FIG. 7 shows a trimming step, FIG. 8 shows a burring step, FIG. 9 shows a piercing step, FIG. 11 is a second bending step, and FIG. 12 is a cutting step.

DETAILED DESCRIPTION

The embodiments described herein are merely the most preferred embodiments of the present disclosure and are not intended to represent all of the technical ideas of the present disclosure, so it should be understood that various equivalents or modifications that may be substituted for the same at the time of filing of the application are also included in the scope of the present disclosure.

Hereinafter, preferred embodiments of the present disclosure will be described in detail with reference to the accompanying drawings.

Figure 1:
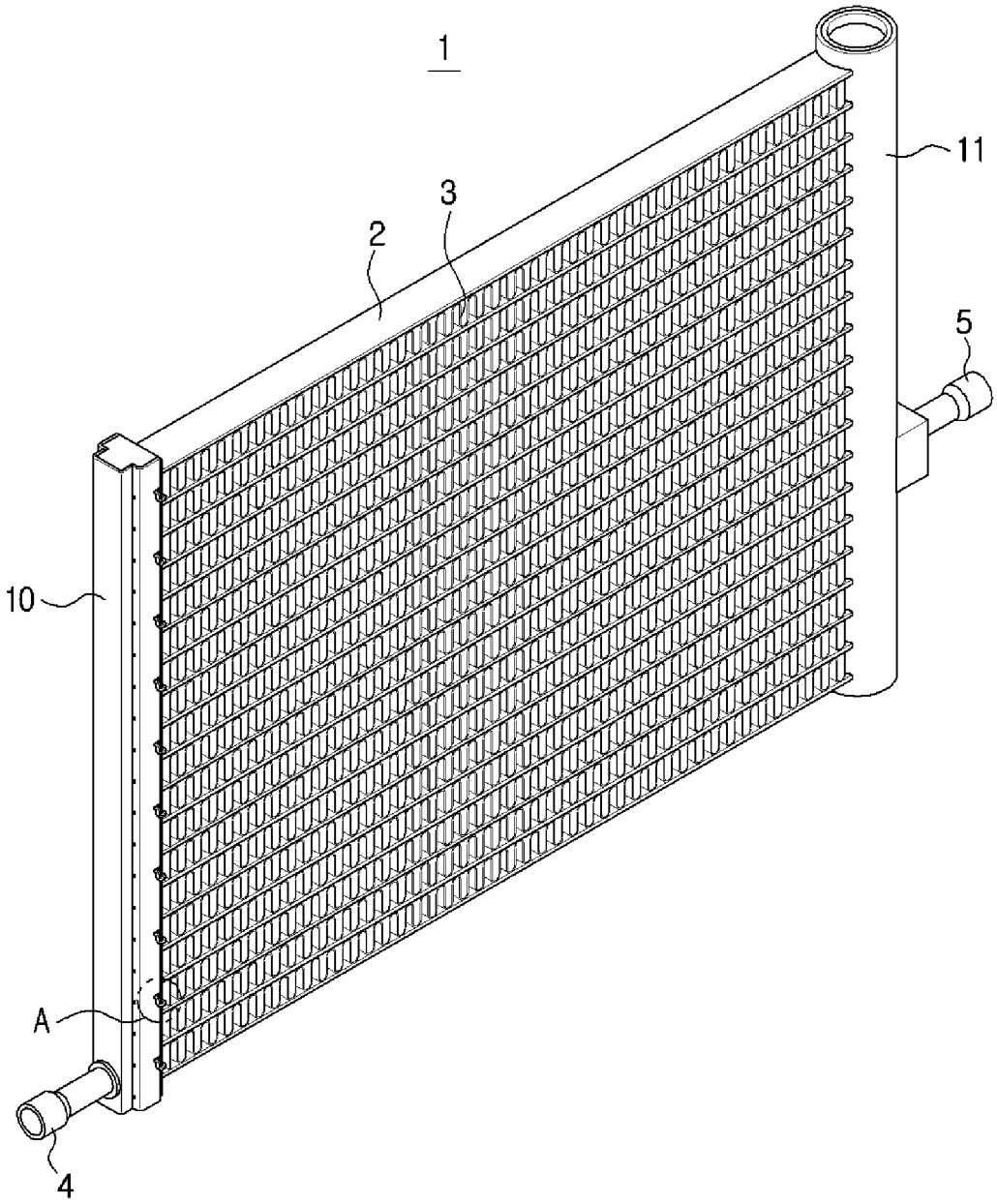
FIG. 1 is a perspective view of a heat exchanger according to an embodiment of the present disclosure.
Figure 2:
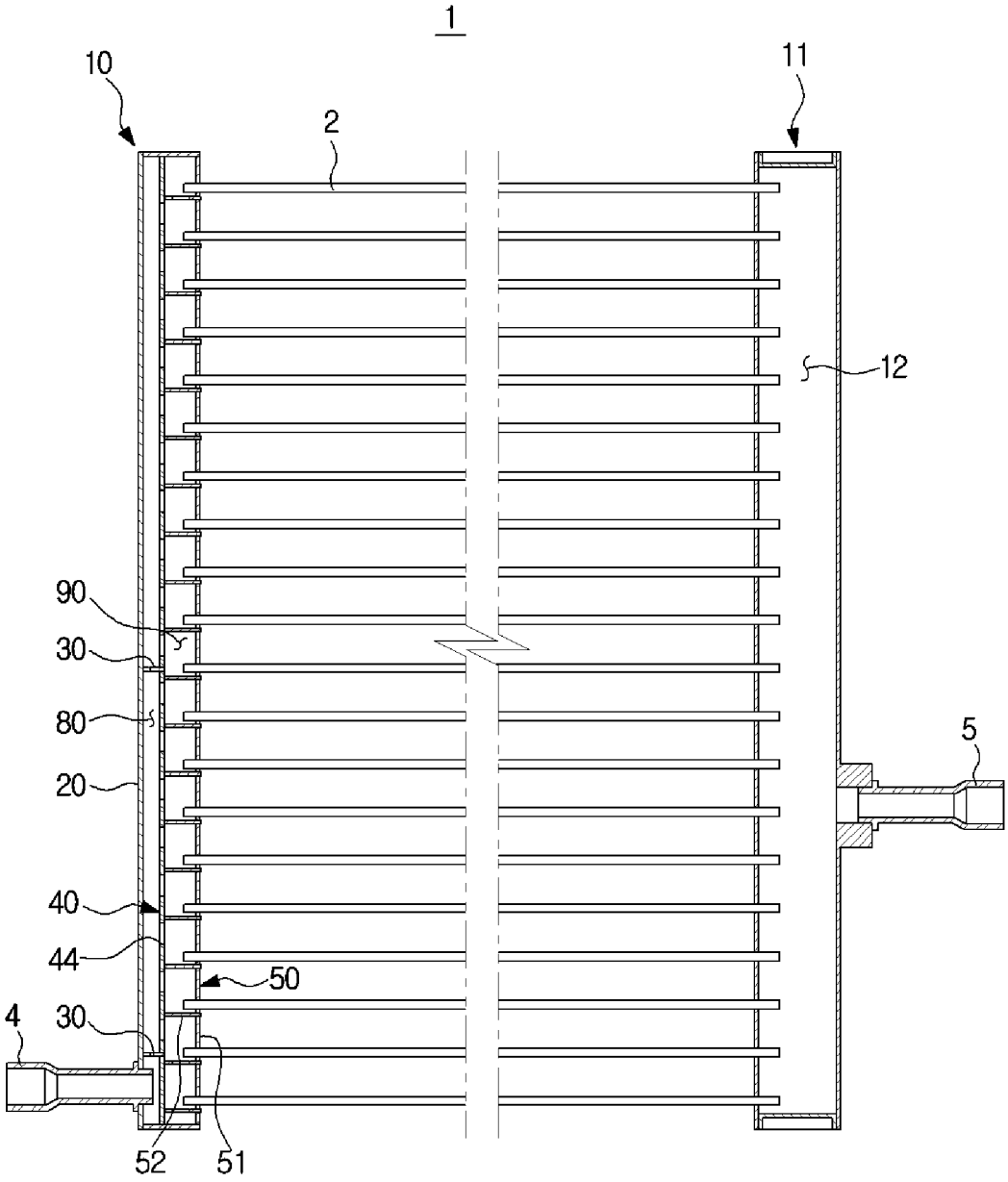
FIG. 2 is a side cross-sectional view showing a schematic structure of the heat exchanger of FIG. 1.
Figure 3:
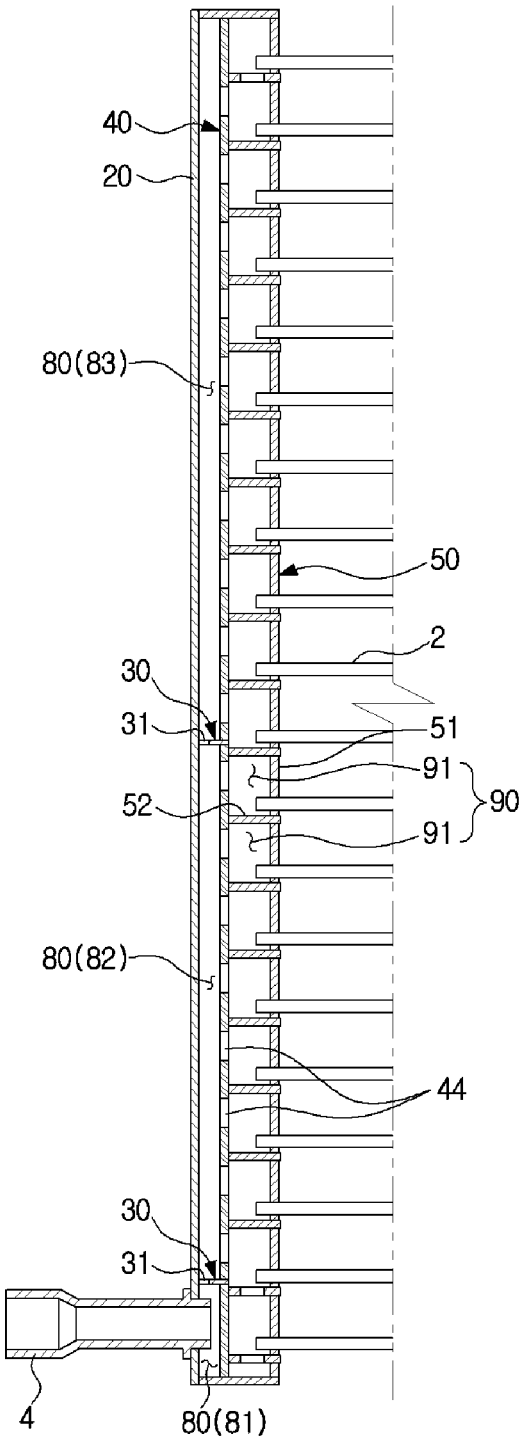
FIG. 3 is an enlarged side cross-sectional view of the structure of the header of the heat exchanger of FIG. 1.
Figure 4:
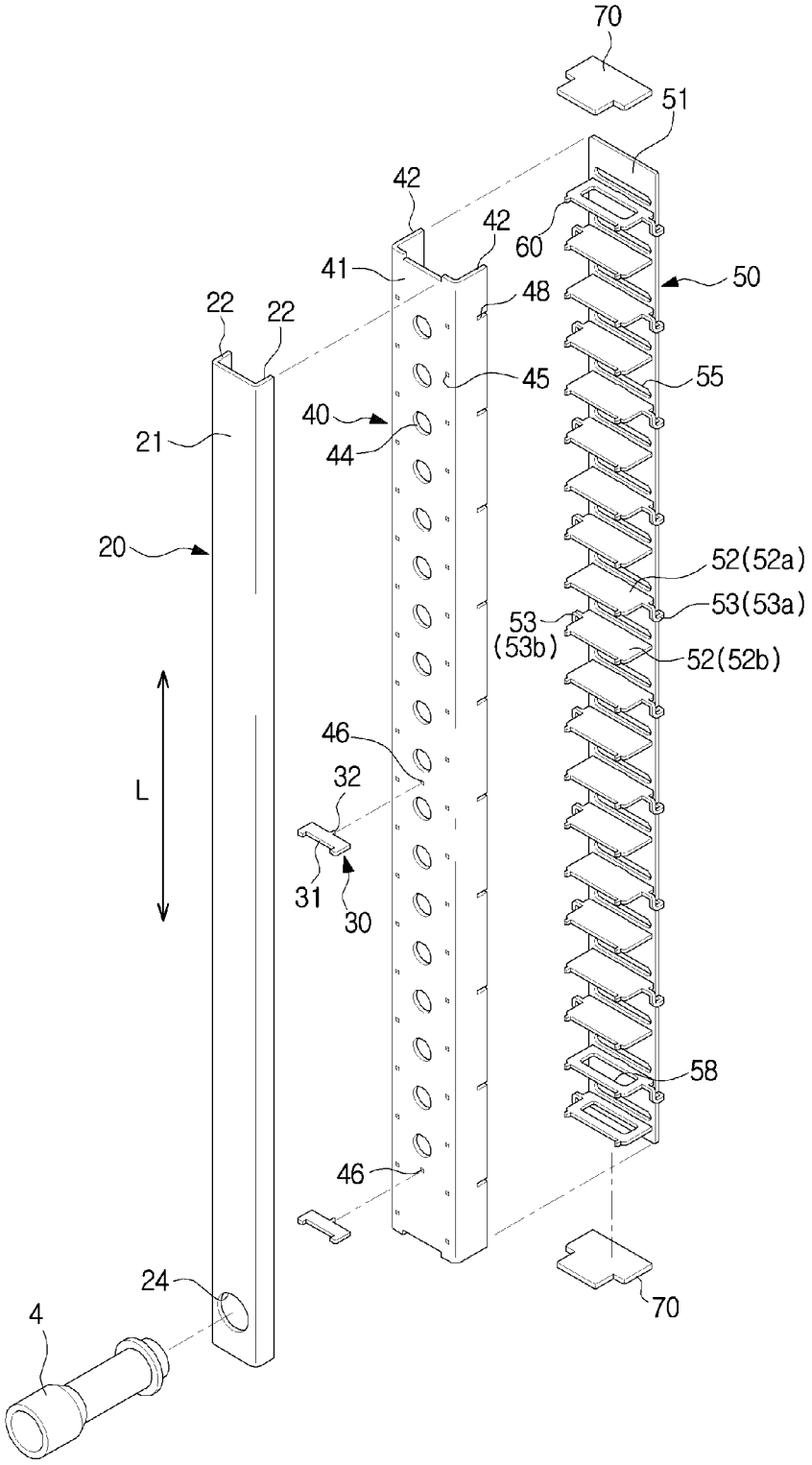
FIG. 4 is an exploded view of the header of the heat exchanger of FIG. 1.
Figure 5:
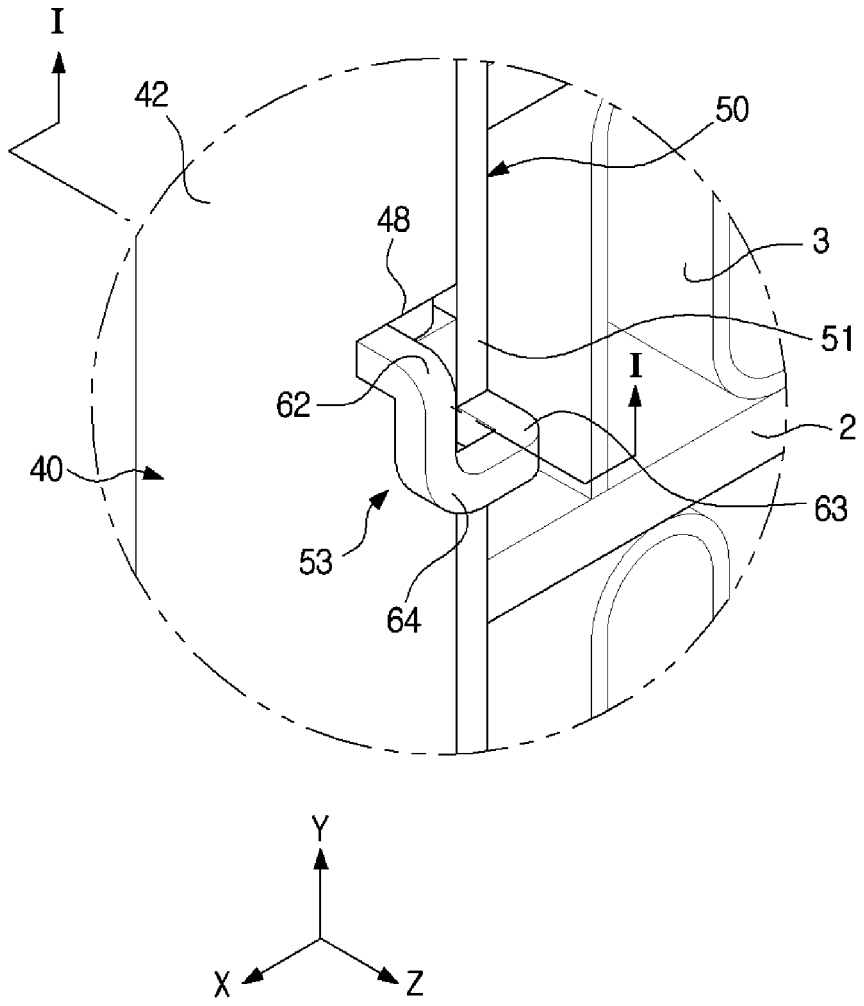
FIG. 5 is an enlarged view of a portion 'A' in FIG. 1.
Figure 6:
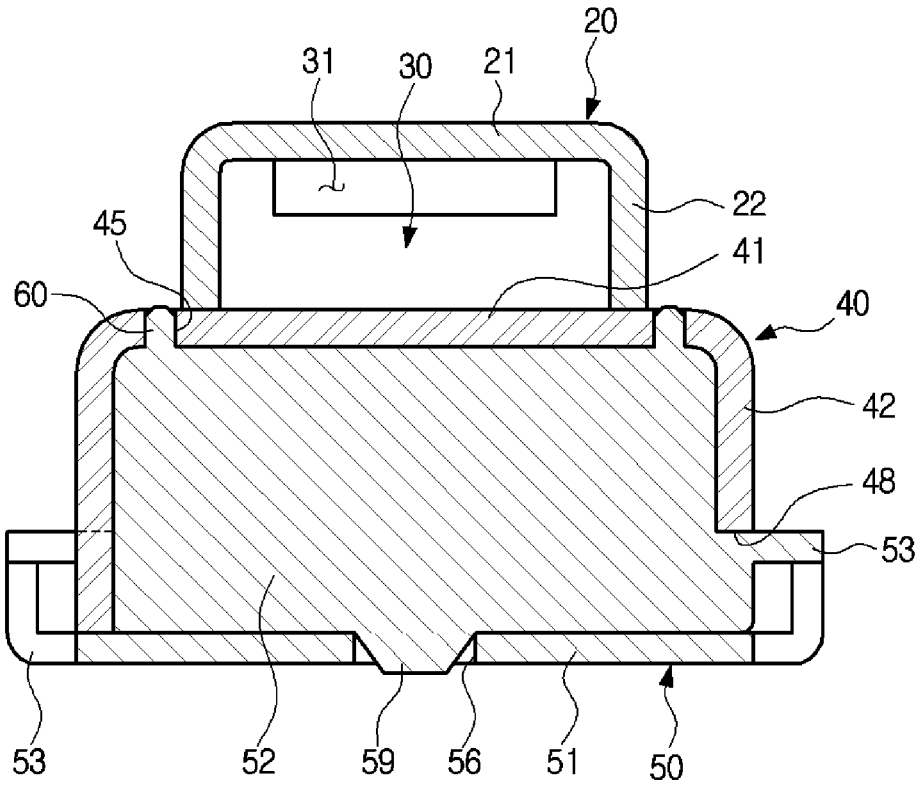
FIG. 6 is a cross-sectional view taken along a line I-I in FIG. 4.

FIG. 1 is a perspective view of a heat exchanger according to an embodiment of the present disclosure. FIG. 2 is a side cross-sectional view showing a schematic structure of the heat exchanger of FIG. 1. FIG. 3 is an enlarged cross-sectional side view of the structure of the header of the heat exchanger of FIG. 1. FIG. 4 is an exploded view of the header of the heat exchanger of FIG. 1. FIG. 5 is an enlarged view of a portion 'A' in FIG. 1. FIG. 6 is a cross-sectional view taken along a line I-I in FIG. 4.

Referring to FIGS. 1 to 6, the heat exchanger 1 may include a plurality of tubes 2 that are arranged to exchange heat with outside air by having a refrigerant flow therein, an inlet header 10 for receiving a refrigerant from outside and distributing the refrigerant to a plurality of tubes 2, an outlet header 11 for collecting the refrigerant from the plurality of tubes 2 and guiding the refrigerant to the outside, and a heat exchange fin 3 provided to be in contact with the tube 2 to increase the heat transfer area.

The plurality of tubes 2 are arranged horizontally. One end of the tube 2 may be coupled to the inlet header 10 and the other end of the tube 2 may be coupled to the outlet header 11. The headers 10 and 11 may be arranged vertically. The tube 2 may have a microchannel through which the refrigerant flows. The tube 2 may have a flat shape or a circular shape.

An inlet pipe 4 for guiding an outside refrigerant to the header 10 may be coupled to the header 10, and an outlet pipe 5 for guiding a refrigerant of the header 11 to the outside is provided in the header 11. The inlet pipe 4 may be coupled to the lower part of the header 10.

The header 10 includes a cover body 20 to which the inlet pipe 4 is coupled, an middle body 40 coupled to the cover body 20 to form a distribution chamber 80 with the cover body 20, and a base body 50 coupled to the middle body 40 to form the guiding chamber 90 with the middle body 40. The tube 2 may be coupled to the base body 50.

The cover body 20 may include a cover wall 21, and cover sidewalls 22 formed on both sides of the cover wall 21. The cover wall 21 may be provided with a coupling hole 24 into which the inlet pipe 4 may be coupled.

The middle body 40 may include a middle wall 41 defining the distribution chamber 80 with the cover body 20 and a middle sidewall 42 formed on opposite sides of the middle wall 41.

The middle wall 41 may be provided with a plurality of distribution holes 44 for distributing the refrigerant flowing in the distribution chamber 80. The refrigerant in the distribution chamber 80 may be moved to the guide chamber 90 through the plurality of distribution holes 44. A boosting baffle 30 may be installed in the middle body 40 to divide the distribution chamber 80 into a plurality of distribution sections 81, 82, 83. For this, the middle wall 41 is provided with a boosting projection insertion hole 46 into which the boosting projection 32 of the boosting baffle 30 is inserted. The middle wall 41 may be formed with a partition wall projection insertion hole 45 into which a partition wall projection 60 of the partition wall 52 as will be described later is inserted.

The middle sidewall 42 may be formed with a connecting portion insertion groove 48 into which a connecting portion 53 as will described later is inserted.

The base body 50 may include a base wall 51 having a tube insertion hole 55 into which the tube 2 is inserted and forming a guide chamber 90 together with the middle body 40, the partition wall 52 partitioning the guide chamber into a plurality of guide sections 91, and the connecting portion 53 connecting the base wall 51 and the partition wall 52.

The number of guide sections 91 corresponds to the number of tubes 2, and the guide sections 91 may correspond one-to-one with the tubes 2.

The partition wall 52 may be disposed substantially perpendicular to the base wall 51. The partition walls 52 may be arranged at predetermined intervals along the longitudinal direction L of the header. A plurality of partition walls 52 may be provided. The partition walls 52*a* and 52*b* adjacent to each other may be connected to the connecting portion 53*a* and the connecting portion 53*b*, respectively, and the connecting portions 53*a* and 53*b* may be positioned in opposite directions. That is, the connecting portion 53 may be formed in a zigzag manner along the longitudinal direction L of the header 10 as a whole.

As shown in FIG. 5, the connecting portion 53 may include a plurality of bending portions 62, 63, and 64. The connecting portion 53 may be bent from a plurality of bending portions 62, 63, and 64. The connecting portion 53 may be bent about 90 degrees from each of the bending portions 62, 63, and 64.

The plurality of bending portions 62, 63, and 64 may include a first bending portion 62, a second bending portion 63, and a third bending portion 64. The first bending portion 62 may be bent with respect to the first axis X, the second bending portion 63 may be bent with respect to the second axis Y, and the third bending portion 64 may be bent with respect to the third axis Z. Here, the first axis X, the second axis Y, and the third axis Z may be orthogonal to each other.

As will be described later, the first bending portion 62 and the second bending portion 63 may be formed by a bending process, and the third bending portion 64 may be formed by a trimming process.

The connecting portion 53 may be inserted into the connecting portion insertion groove 48 formed in the middle sidewall 42 of the middle body 40. At least a part of the connecting portion 53 may protrude out of the middle body 40.

The partition wall 52 may be brought into close contact with the middle body 41 and the base wall 51 so as to completely separate the adjacent guide sections 91 from each other.

The partition wall 52 may have a partition wall projection 60 that is inserted into the partition wall projection insertion hole 45 of the middle body 40. Further, the partition wall 52 may have a partition wall projection 59 that is inserted into the partition wall projection insertion hole 56 of the base wall 51. The partition wall 52 provided at both ends of the header 10 in the longitudinal direction L may have a through hole 58 formed for allowing refrigerant to pass therethrough.

At both ends in the longitudinal direction L of the header 10, an end wall 70 for sealing the both ends of the distribution chamber 80 and the guide chamber 90 may be combined.

The distribution chamber 80 may have a boosting baffle 30 installed to increase the pressure to increase the flow rate of the refrigerant. The boosting baffle 30 may have a boosting projection 32 adapted to be inserted into the boosting projection insertion hole 46 of the middle body 40.

The boosting baffle 30 is provided to block the flow of the refrigerant inside the distribution chamber 80, and has a boosting hole 31 which is provided to pass the refrigerant. That is, the cross-sectional area of the space through which the refrigerant flows is reduced to increase the pressure, so that the flow rate of the refrigerant may be increased by the boosting baffle 30.

The distribution chamber 80 may be partitioned by the boosting baffle 30 into a first distribution section 81, a second distribution section 82 and a third distribution section 83. The inlet pipe 4 may be connected to the first distribution section 81.

The refrigerant introduced into the first distribution section 81 through the inlet pipe 4 may be accelerated to flow into the second distribution section 82 by the boosting baffle 30. Further, the refrigerant introduced into the second distribution section 82 may also be accelerated to flow to the third distribution section 83 by the boosting baffle 30.

The refrigerant in the second distribution section 82 and the third distribution section 83 may be distributed to the guide chamber 90 through a plurality of distribution holes 44 formed in middle body 40. The plurality of distribution holes 44 may be arranged at predetermined intervals along the longitudinal direction of the header 10.

The guide chamber 90 may be divided into a plurality of guide sections 91 so that the refrigerant distributed by the plurality of distribution holes 44 is guided to the plurality of tubes 2 without mixing. Guide sections 91 may be connected to the distribution holes 44 one by one. However, two or three guide sections 91 may be connected to the distribution hole 44 formed at both longitudinal ends of the header 10.

The base body 50 may have a base wall 51 to which a plurality of tubes 2 are coupled and a partition wall 52 for partitioning the guide chamber 90 into a plurality of guide sections 91. The number of guide sections 91 may correspond to the number of tubes 2, and the plurality of guide sections 91 and the plurality of tubes 2 may correspond one to one with each other.

With the above structure, the refrigerant introduced from outside through the inlet pipe 4 is evenly distributed to the plurality of guide sections 91 through the distribution hole 44 while flowing through the distribution chamber 80, and the refrigerant introduced into the guide section 91 may be guided to the corresponding tube 2 as it is without being mixed with the refrigerant of the other guide section 91. The refrigerants guided to the respective tubes 2 are heat-exchanged with the outside air while flowing through the tubes 2, merged in the outlet chamber 12 of the header 11, and then discharged to the outside through the outlet pipe 5.

In this structure, a large number of partition walls 52 are required to allow the refrigerants distributed through the distribution holes 44 to be guided to the tube 2 without being mixed with each other. As many partition walls 52 as a number of tubes 2 are required for the guide section 91 to correspond one-to-one with the tubes 2 as in the embodiment of the present disclosure.

As the number of the partition walls 52 increases, an amount of making the partition walls 52 increases and an amount of work for assembling the partition walls 52 in the guide chambers 90 increases, which may be disadvantageous in terms of productivity and cost. Therefore, according to the embodiment of the present disclosure, the base wall 51 of the base body 50 and the partition wall 52 of the base body 51 may be integrally formed to solve this problem. In addition, the base body 50 may be mass-produced through a simple and automated processing procedure of a progressive type.

Figure 7:
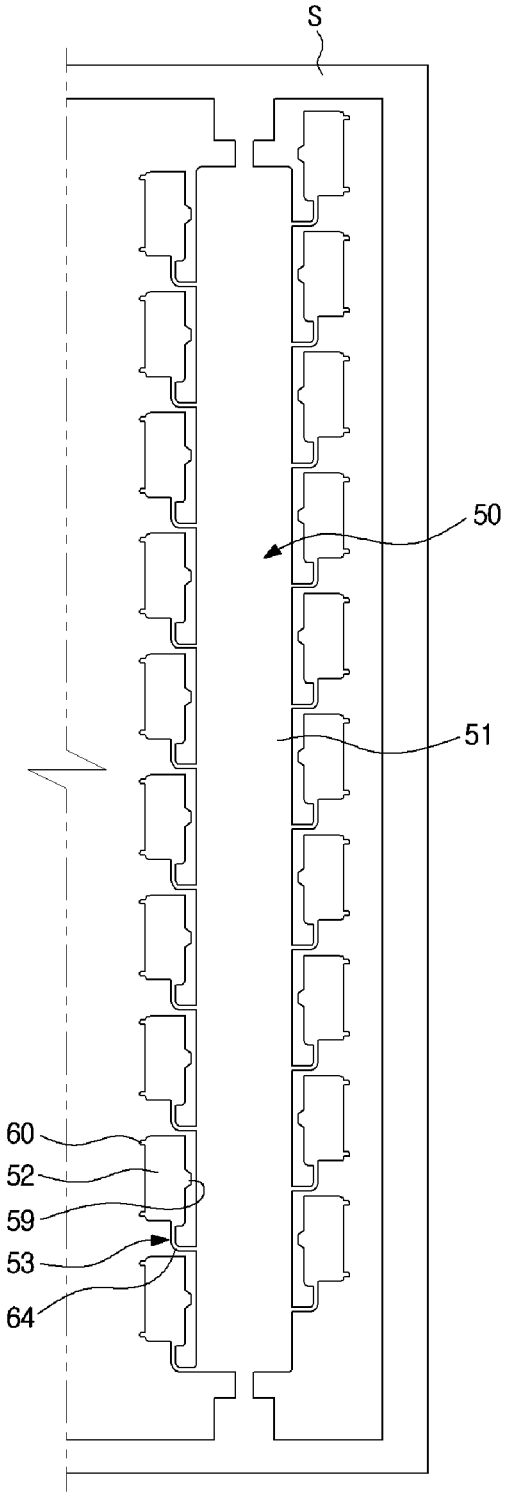
FIGS. 7 to 12 show a process of forming a base body of the header of the heat exchanger of FIG. 1.
Figure 8:
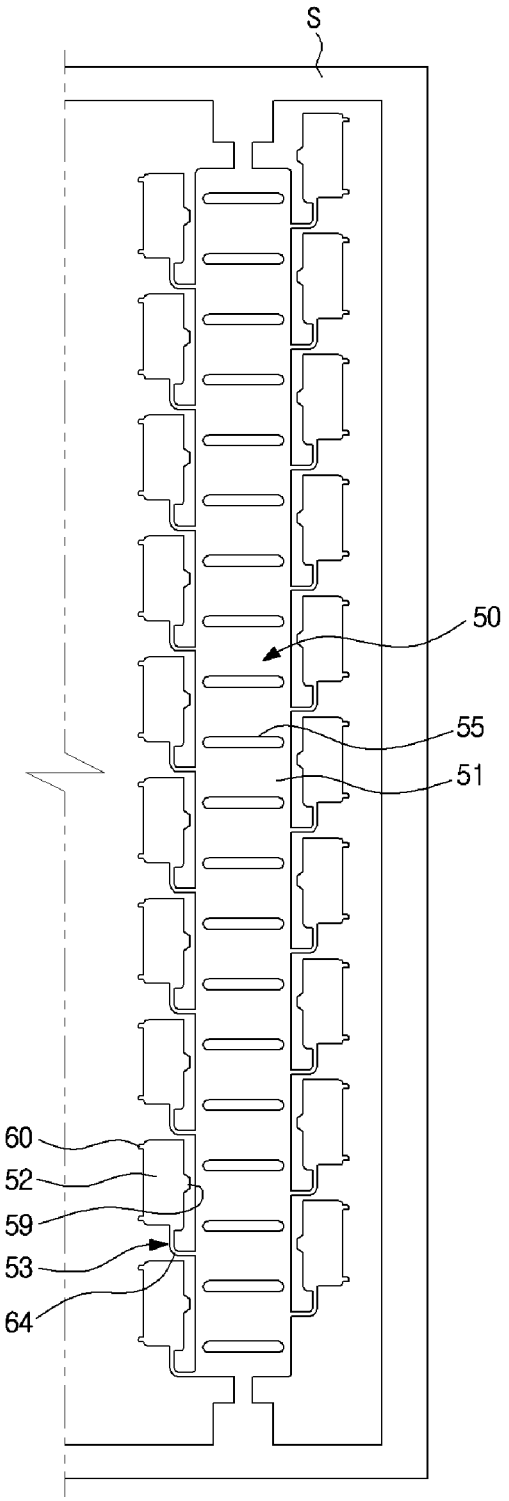
Figure 9:
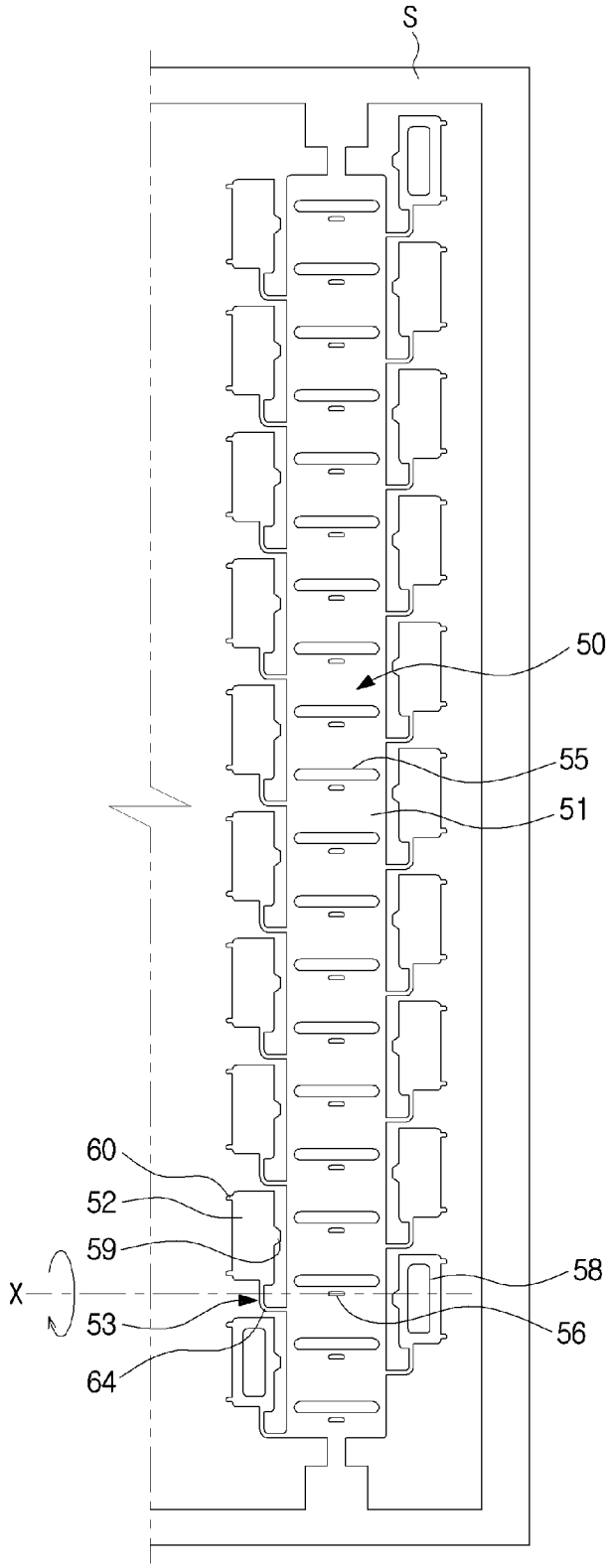
Figure 10:
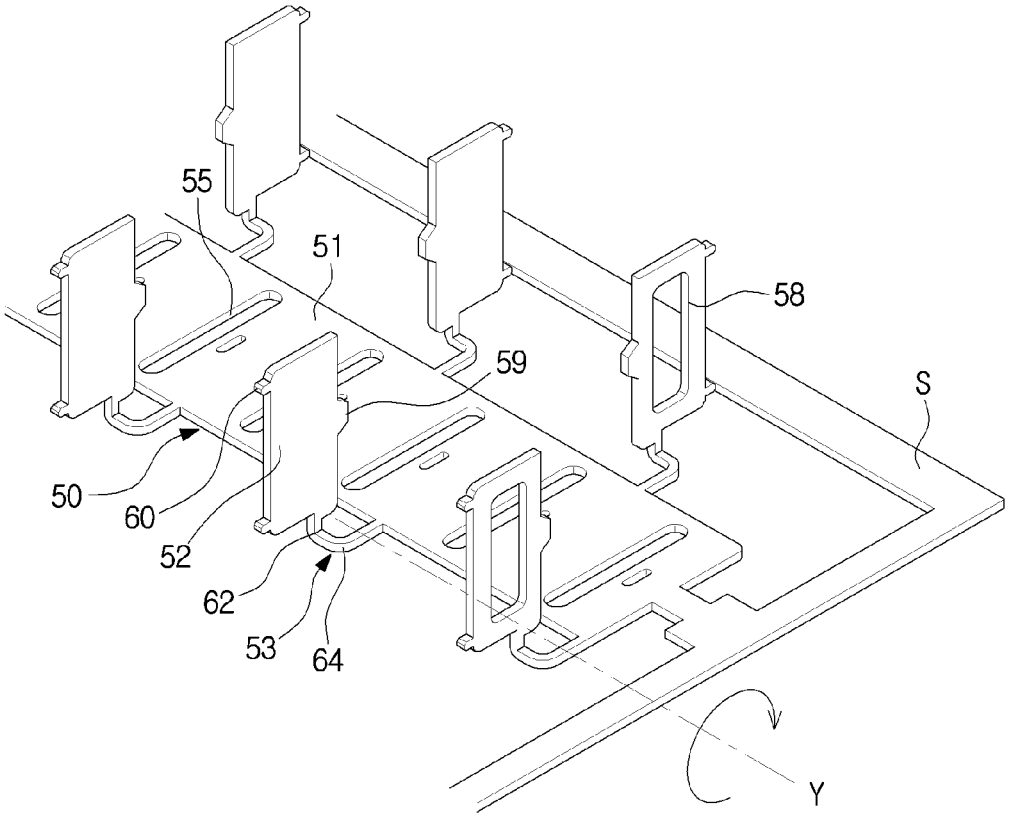
Figure 11:
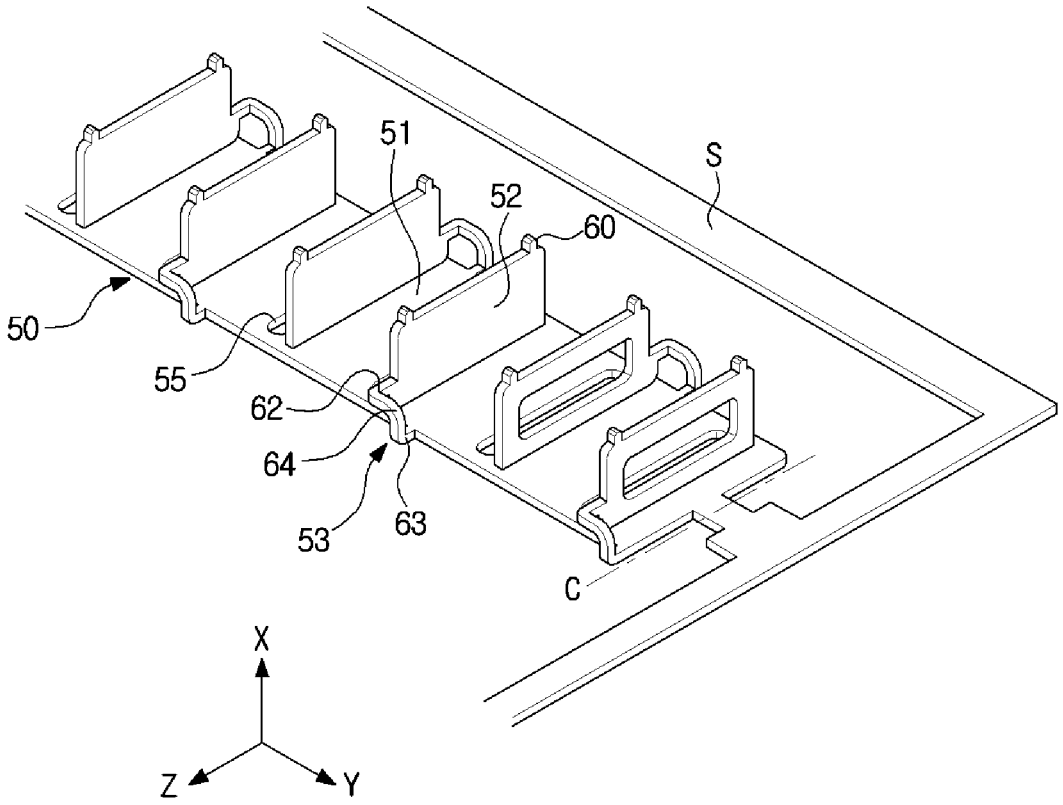
Figure 12:
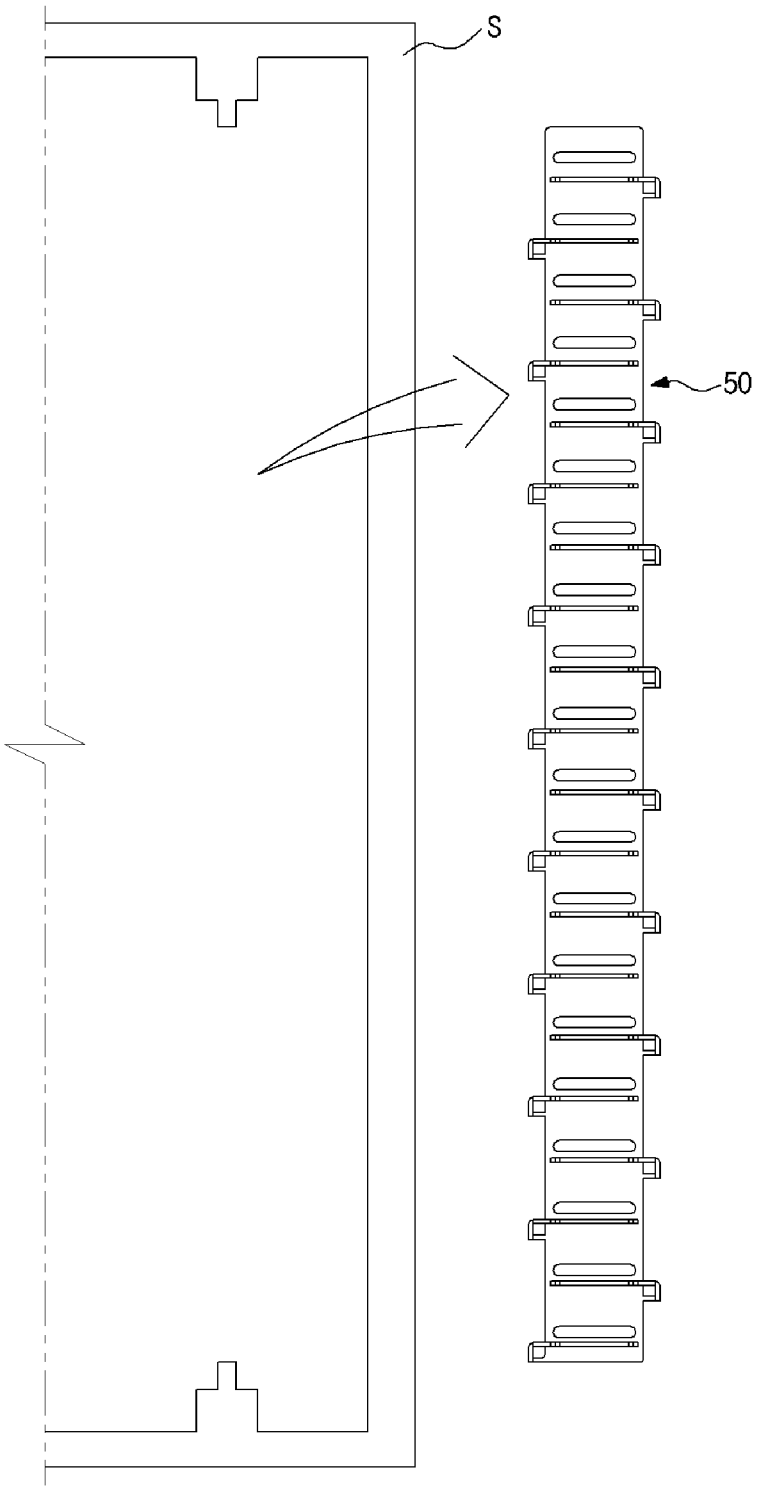
Figure 13:
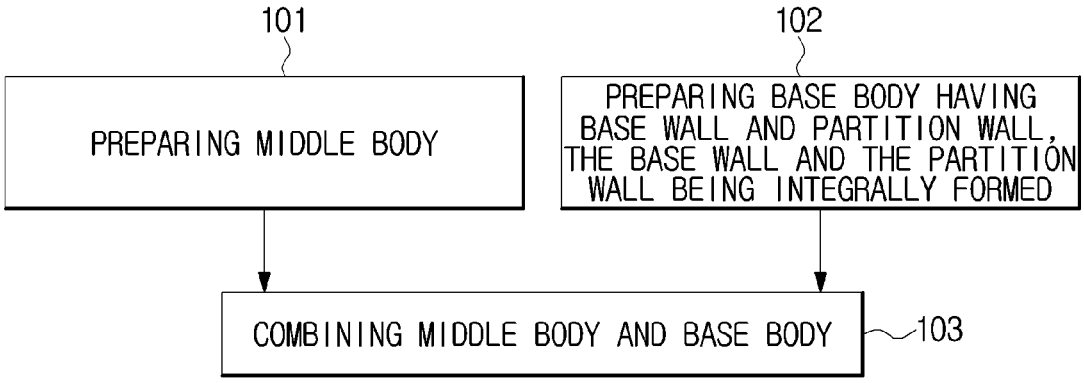
FIGS. 13 to 14 are views showing a manufacturing method of the heat exchanger of FIG. 1.
Figure 14:
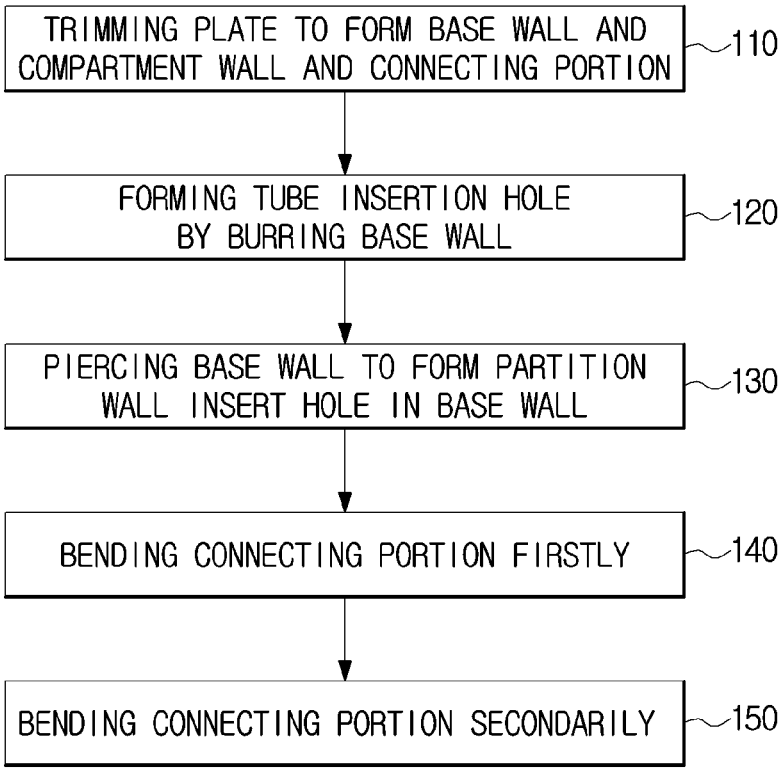

FIGS. 7 to 12 show a process of forming the base body of the header of the heat exchanger of FIG. 1: FIG. 7 shows a trimming step, FIG. 8 shows a burring step, FIG. 9 shows a piercing step, FIG. 11 is a second bending step, and FIG. 12 is a cutting step. FIGS. 13 to 14 are views showing a manufacturing method of the heat exchanger of FIG. 1.

Referring to FIGS. 7 to 14, a method of manufacturing a header of a heat exchanger according to an embodiment of the present disclosure will be described.

A method of manufacturing a header of a heat exchanger includes preparing a middle body 40 (101), preparing a base body 50 in which a base wall 51 and a partition wall 52 are integrally formed (102), and combining the middle body 40 and the base body 50 (103).

Hereinafter, preparation of the base body 50 in which the base wall 51 and the partition wall 52 are integrally formed will be described in detail.

First, as shown in FIG. 7, one metal sheet S is trimmed to form the base wall 51, the partition wall 52, and the connecting portion 53 (110). The partition wall 52 may have a projection 59 to be coupled to the base wall 51 and a projection 60 to be coupled to the middle wall 41.

Next, as shown in FIG. 8, the base wall 51 is burred to form a tube insertion hole 55 into which the tube 2 is inserted (120).

Next, as shown in FIG. 9, the base wall 51 is pierced to form a projection insertion hole 56. At this time, a through hole 58 may also be formed in the partition wall 52 (130).

Next, as shown in FIGS. 9 and 10, the connecting portion 53 is bent first (130). When the connecting portion 53 is bent around the X-axis, the first bending portion 62 is formed and the partition wall 52 may be lifted up the plate S.

Next, as shown in FIG. 11, the connecting portion 53 is secondarily bent (140). When the connecting portion 53 is bent around the Y axis, the second bending portion 63 is formed and the partition wall 52 may be engaged with the base wall 51.

Next, as shown in FIG. 12, the plate body S is cut along the line C to separate the base body 50 from the plate body S.

According to embodiments of the present disclosure, the refrigerant distribution characteristics may be improved and the heat transfer performance of the heat exchanger may also be improved.

According to embodiments of the present disclosure, processing and assembling may be simplified, thereby saving the cost and time.

Although the technical idea of the present disclosure has been described with reference to specific embodiments, the scope of rights of the present disclosure is not limited to these embodiments. It is intended that the present disclosure covers various embodiments that can be modified by those skilled in the art within the scope of the appended claims and their equivalents.

What is claimed is:

1. A heat exchanger comprising:

a plurality of tubes configured to transport a refrigerant to exchange heat with surrounding air; and a header having a chamber adapted to distribute the refrigerant to the plurality of tubes, wherein the header comprises:

a base wall having a plurality of tube insertion holes, into which the plurality of tubes are inserted, and a first partition wall integrally formed with the base wall by a first connecting portion extending from the first partition wall to the base wall, and configured to divide the chamber into a first plurality of sections respectively corresponding to a first portion of the plurality of tubes, and a second partition wall integrally formed with the base wall by a second connecting portion extending from the first partition wall to the base wall, and configured to divide the chamber into a second plurality of sections respectively corresponding to a second portion of the plurality of tubes, wherein the first connecting portion and the second connecting portion are arranged on opposite ends of the first partition wall and the second partition wall, respectively, so that the first connecting portion and the second connecting portion are alternately arranged in a zigzag manner on the base wall in a longitudinal direction of the header.

2. The heat exchanger according to claim 1, wherein the first connecting portion extends from an edge of the first partition wall to an edge of the base wall to connect the base wall and the partition wall, wherein the edge of the first partition wall is perpendicular to the edge of the base wall.

3. The heat exchanger according to claim 2, wherein the first connecting portion comprises a plurality of bending portions, the first connecting portion formed by the plurality of bending portions.

4. The heat exchanger according to claim 3, wherein the plurality of bending portions comprise a first bending portion bent with respect to a first axis, a second bending portion bent with respect to a second axis, and a third bending portion bent with respect to a third axis.

5. The heat exchanger according to claim 2, wherein the first partition wall and the second partition wall are adjacent to each other.

6. The heat exchanger according to claim 1, wherein the base wall has a partition wall projection insertion hole, and wherein the first partition wall has a partition wall projection to be inserted into the partition wall projection insertion hole.

7. The heat exchanger according to claim 2, wherein the header further comprises:

a base body including the base wall, the first partition wall, and the first connecting portion; and a middle body coupled to the base body to form the chamber.

8. The heat exchanger according to claim 7, wherein the middle body comprises a middle sidewall, and wherein the middle side wall is formed with a connecting portion insertion groove into which the first connecting portion is inserted.

9. The heat exchanger according to claim 7, wherein the middle body comprises a middle wall, and wherein the middle wall is provided with a plurality of distribution holes arranged to distribute the refrigerant.

10. A header for heat exchanger, the header comprising:

a cover body coupled to an inlet pipe arranged to transport a refrigerant;

a middle body coupled to the cover body to form a distribution chamber for distributing the refrigerant; and a base body coupled to the middle body to form a guide chamber for guiding the refrigerant to a plurality of tubes arranged to exchange heat with surrounding air, wherein the base body includes a base wall with a plurality of tube insertion holes into which the plurality of tubes are inserted, and a plurality of partition walls formed integrally with the base wall by a plurality of connecting portions, respectively, and configured to divide the guide chamber into a plurality of guide sections respectively corresponding to the plurality of tubes, and wherein the plurality of connecting portions are arranged on opposite ends of the plurality partition walls, respectively, so that the plurality of connecting portions are alternately arranged in a zigzag manner on the base wall in a longitudinal direction of the header.

11. The header according to claim 10, wherein each of the plurality of connecting portions connect an edge of the base wall to an edge of the partition wall perpendicular to the edge of the base wall.

12. The header according to claim 11, wherein each of the plurality of connecting portions comprises a plurality of bending portions, each of the plurality of connecting portions formed by the plurality of bending portions.

13. The header according to claim 11, wherein the middle body has a middle wall with a plurality of distribution holes for distributing the refrigerant of the distribution chamber and a middle sidewall provided on both sides of the middle wall, and wherein the middle sidewall is formed with a connecting portion insertion groove into which a respective connecting portion of the plurality of connecting portions is inserted.

14. The header according to claim 11, wherein at least a part of each of the plurality of connecting portions protrudes outwards from the middle body.

15. A heat exchanger comprising:

a plurality of tubes configured to transport a refrigerant to exchange heat with surrounding air; and a header having a chamber adapted to distribute the refrigerant to the plurality of tubes, wherein the header comprises:

a base wall having a plurality of tube insertion holes, into which the plurality of tubes are inserted, a partition wall integrally formed with the base wall and configured to divide the chamber into a plurality of sections respectively corresponding to the plurality of tubes, and a connecting portion to connect the base wall and the partition wall, wherein the connecting portion comprises a plurality of bending portions, the connecting portion formed by the plurality of bending portions, wherein the plurality of bending portions comprise a first bending portion bent with respect to a first axis, a second bending portion bent with respect to a second axis, and a third bending portion bent with respect to a third axis, and wherein the first axis, the second axis, and the third axis are orthogonal to each other.

* * * * *